US007803010B1

(12) United States Patent
Hwang

(10) Patent No.: US 7,803,010 B1
(45) Date of Patent: Sep. 28, 2010

(54) SIGNAL LINE CONNECTOR STRUCTURE OF COMPUTER SYSTEM

(76) Inventor: Mao-Lin Hwang, No. 127, Jing An Rd., Chung Ho City, Taipei County (TW)

( * ) Notice: Subject to any disclaimer, the term of this patent is extended or adjusted under 35 U.S.C. 154(b) by 0 days.

(21) Appl. No.: 12/704,073

(22) Filed: Feb. 11, 2010

(51) Int. Cl.
*H01R 12/24* (2006.01)

(52) U.S. Cl. ..... 439/497

(58) Field of Classification Search ..... 439/497, 439/493, 492
See application file for complete search history.

(56) References Cited

U.S. PATENT DOCUMENTS 6,672,905 B2 * 1/2004 Tharp et al. ..... 439/660
6,722,915 B1 * 4/2004 McAlonis et al. ..... 439/498
7,267,575 B1 * 9/2007 Hwang ..... 439/497

* cited by examiner

*Primary Examiner*—Phuong K Dinh
(74) *Attorney, Agent, or Firm*—Rosenberg, Klein & Lee

(57) ABSTRACT

A signal line connector structure of a computer system includes a casing, a first connecting module and a second connecting module. The casing consists of an upper casing and a lower casing. The upper casing includes a first positioning block having a first stop side, and the lower casing includes a second positioning block having a second stop side. The first connecting module and the second connecting module are installed in the casing and abutted and fixed by the first positioning block and the second positioning block respectively to enhance the stability and convenience of the connection. In addition, two connecting modules are used for improving the applicability.

6 Claims, 5 Drawing Sheets

SIGNAL LINE CONNECTOR STRUCTURE OF COMPUTER SYSTEM

BACKGROUND OF THE INVENTION

1. Field of the Invention

The present invention relates to a connector, and more particularly to an improved signal line connector structure of a computer system.

2. Description of the Related Art

In general, hard disks available in the market are divided into traditional IDE hard disks, SCSI hard disks, and new-generation SATA and SAS hard disks. For the hard disks of different specifications, different connectors and flat cables are required. For example, the connector for the IDE hard disk comes with a general flat cable structure. Since the performance and stability of the hard disks are enhanced increasingly, therefore some traditional specifications are no longer used anymore. For example, the IDE hard disks are replaced by the SATA II hard disks and the SCSI hard disks are replaced by the SAS hard disks gradually.

For the SAS hard disks, a signal connecting wire is generally a circular cable connected with a connector to form the so-called "circular flat cable". With reference to FIG. 1 for a schematic view of a conventional circular flat cable, a connector structure of the circular flat cable comprises a casing 41, a circuit board 42 and a cable 43, wherein all connecting wires 431 (including a ground line and signal lines) of the cable 43 are soldered directly at contact points on printed circuits (on both upper and lower sides) of the circuit board 42, and the casing 41 is formed by an injection molding process after the circuit board 42 and the cable 43 are connected. As described above, the flat cable generally has at least 26 pins, and thus an electric wire having more than 20 pins is soldered to a circuit board 42 having a very limited width will become too dense, involve a high level of difficulty for the manufacture, and result in short circuits. Furthermore, when the cable 43 and the circuit board 42 of the conventional flat cable are connected, each electric wire is not fixed in position, such that wire ends at the soldered positions will be in disorder, and will make the wire peeling and soldering processes difficult or will give rise to an increased defective rate. Furthermore, the casing 41 of the conventional connector is formed by the molding process in a production line directly, so that the defective products cannot be reworked easily and result in unnecessary wastes. Obviously, the conventional structure requires further improvements.

SUMMARY OF THE INVENTION

In view of the shortcomings of the prior art, the inventor of the present invention based on years of experience in the related industry to conduct extensive researches and experiments, and finally developed a signal line connector structure of a computer system in accordance with the present invention to overcome the shortcomings of the prior art.

Therefore, it is a primary objective of the present invention to overcome the aforementioned shortcoming and deficiency of the prior art by providing a signal line connector structure of computer system, and the improved connector structure is simple, easy-to-assemble, easy-to-solder, stable, convenient and highly applicable.

To achieve the foregoing objective, the present invention provides a signal line connector structure of a computer system, comprising: a casing, a first connecting module and a second connecting module. The casing comprises: an upper casing, having a first positioning block, and the first positioning block having a first stop side; and a lower casing, connected to the upper casing, and having a second positioning block, and the second positioning block having a second stop side. The first connecting module is disposed in the casing and comprises: a first circuit board, abutted and fixed by the second stop side through the first positioning block; a first wire clamping module, for collecting the signal lines; and a first grounding clamp module, clamped with the first wire clamping module integrally and connected to the first circuit board. The second connecting module is disposed in the casing, and comprises: a second circuit board, abutted and fixed by the first stop side through the second positioning block; a second wire clamping module, for collecting the signal lines; and a second grounding clamp module, clamped with the second wire clamping module integrally and connected to the second circuit board.

In the present invention, the casing is formed integrally by a plastic injection molding process or a metal die casting process. To enhance the convenience of the assembling process, the first wire clamping module and the second wire clamping module are formed respectively and symmetrically by two separate plastic clamping plates, and each plastic clamping plate includes a plurality of wire slots penetrated through the plastic plates, and a plurality of flanges corresponding to the signal lines for disposing a plurality of clamp openings of the signal lines respectively. The first grounding clamp module and the second grounding clamp module are formed respectively and symmetrically by two identical metal clamps, and each metal clamp includes a fork frame and a latch hole disposed on a side of the metal clamp, and a latch plate corresponding to the latch hole and disposed on another side of the metal clamp, such that the fork frames can be used for clamping the first circuit board and the second circuit board respectively.

The present invention is characterized in that the wire clamping module and the grounding clamp module are provided for a more stable and convenient assembling process. In the meantime, the casing contains two connecting modules at the same time, so that the invention can provide a wider scope of applicability.

DETAILED DESCRIPTION OF THE PREFERRED EMBODIMENTS

The technical characteristics of the present invention will become apparent with the detailed description of the preferred embodiments and the illustration of the related drawings.

Figure 1:
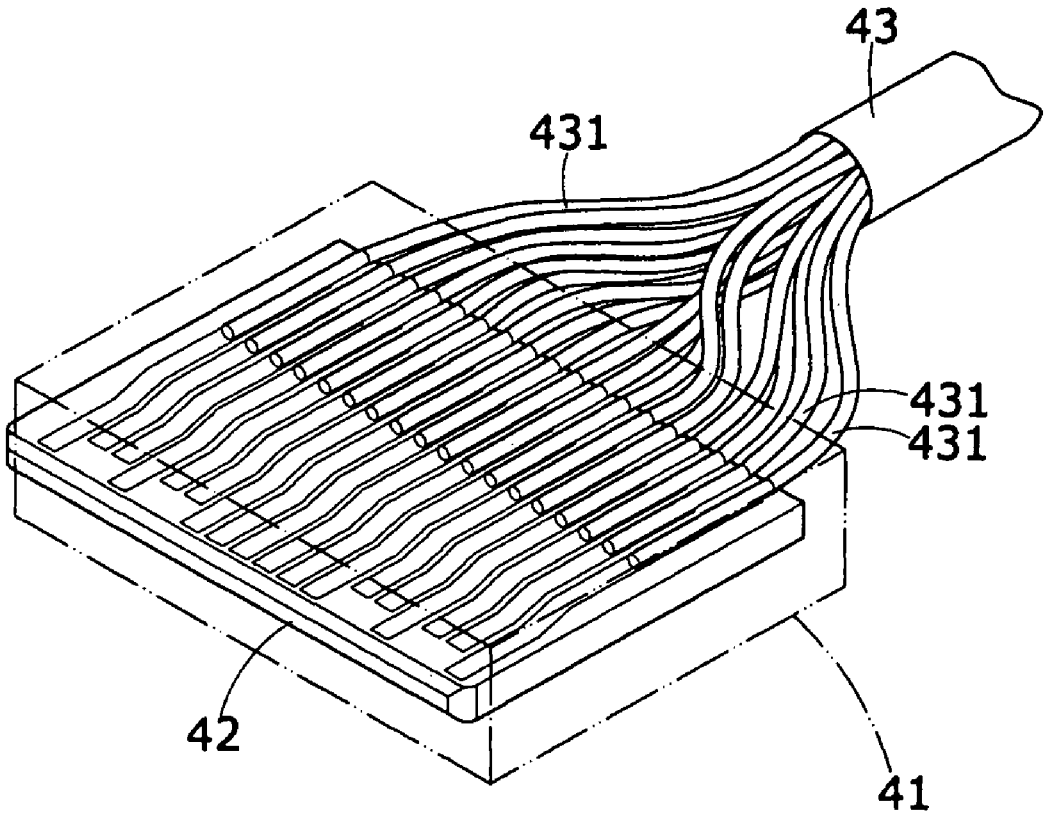
Fig.1(PRIOR ART)
FIG. 1 is a schematic view of a conventional flat cable.
Figure 2:
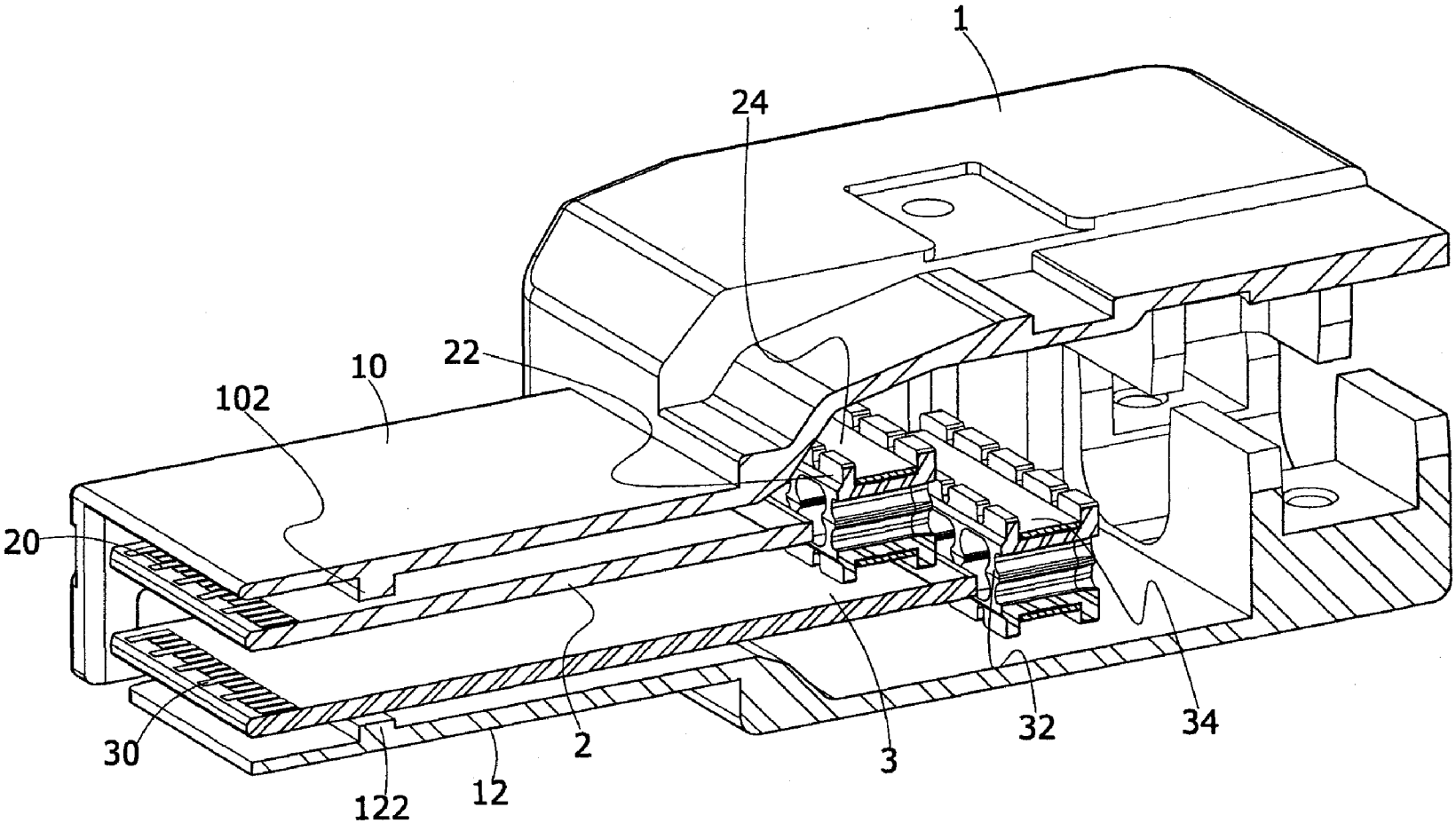
FIG. 2 is a perspective view in accordance with a preferred embodiment of the present invention.
Figure 3:
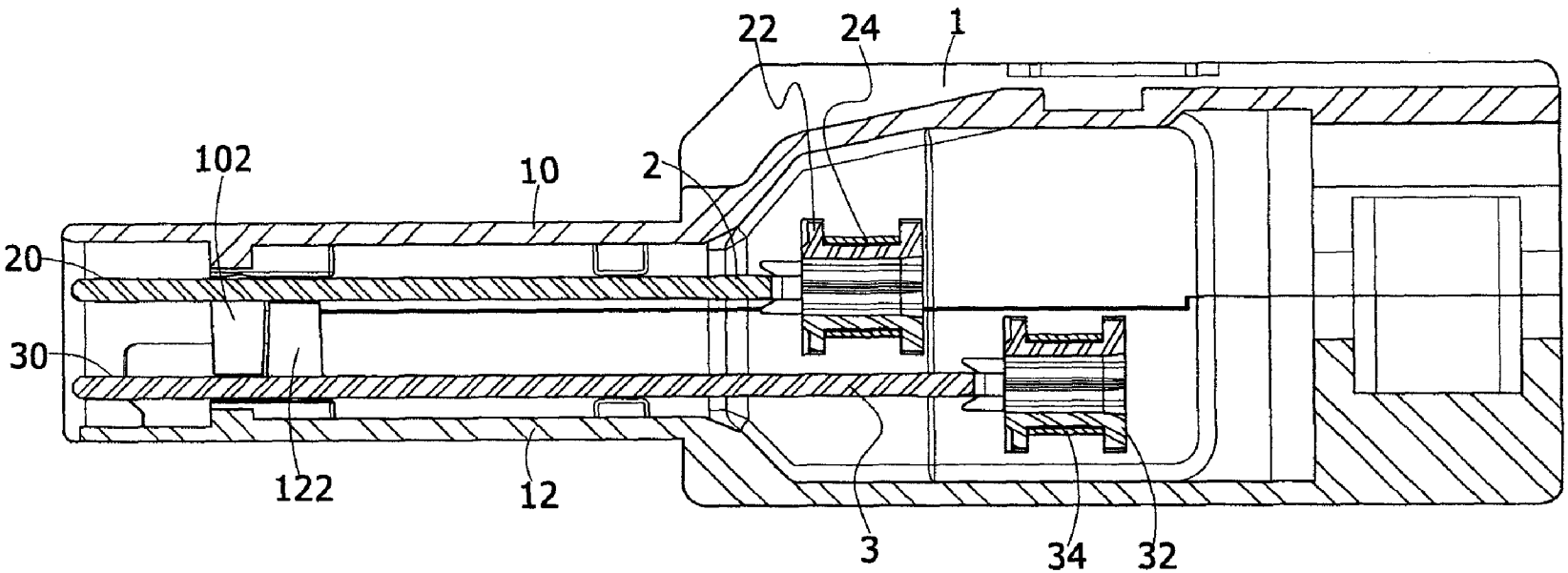
FIG. 3 is a cross-sectional view in accordance with a preferred embodiment of the present invention.
Figure 4:
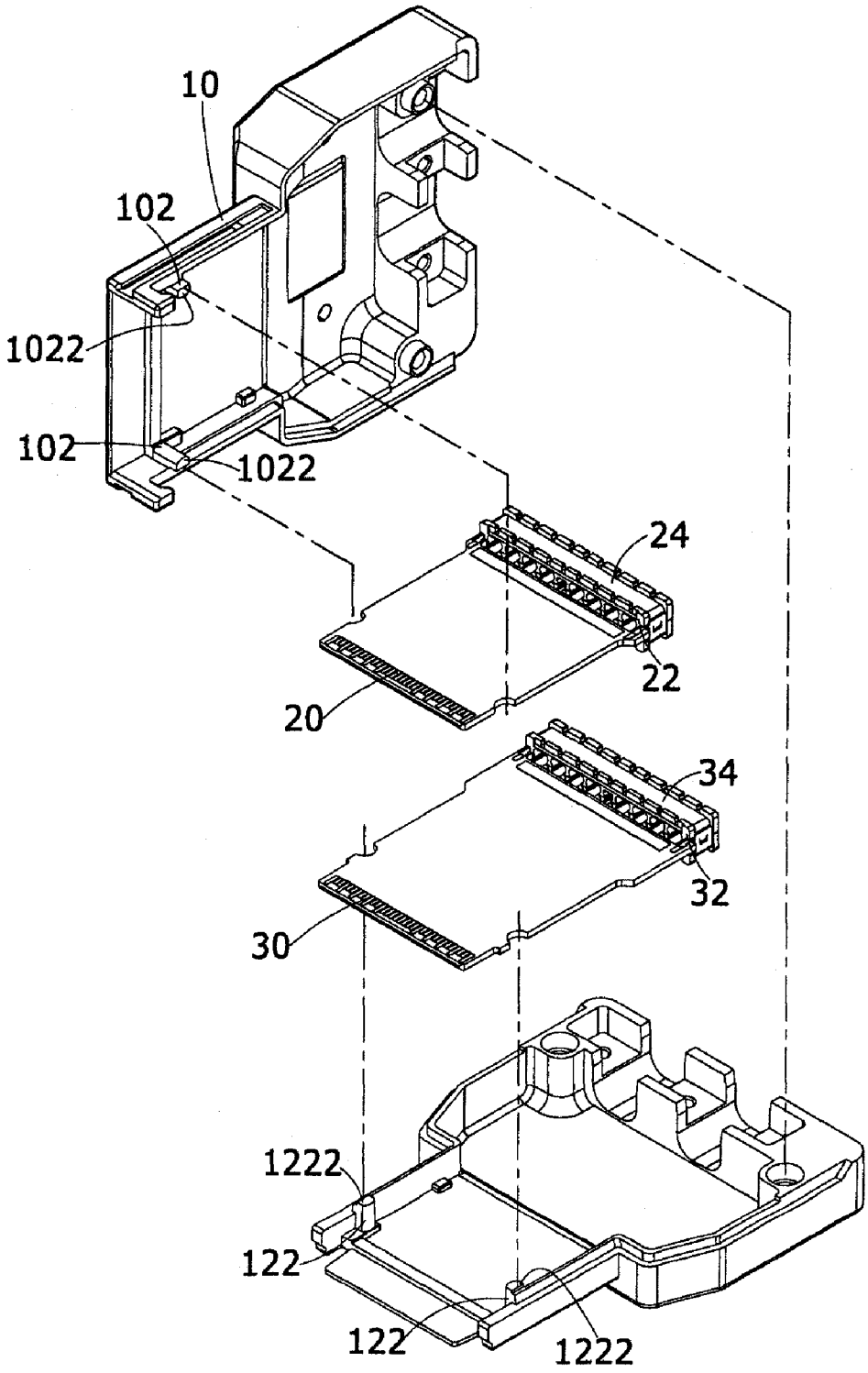
FIG. 4 is an exploded view in accordance with a preferred embodiment of the present invention.

With reference to FIGS. 2 to 4 for a perspective view, a cross-sectional view and an exploded view of a signal line connector structure of a computer system in accordance with a preferred embodiment of the present invention respectively, the signal line connector structure comprises a casing 1, a first connecting module 2 and a second connecting module 3. The casing 1 comprises an upper casing 10 and a lower casing 12. The first connecting module 2 comprises a first circuit board 20, a first wire clamping module 22 and a first grounding clamp module 24, and the second connecting module 3 comprises a second circuit board 30, a second wire clamping module 32 and a second grounding clamp module 34.

The signal line connector structure of a computer system in accordance with the present invention is characterized in that the casing 1 contains two separate connecting modules, respectively: the first connecting module 2 and the second connecting module 3. For the installation, the upper casing 10 of the casing 1 includes a first positioning block 102, and a first stop side 1022 on the first position block 102; the lower casing 12 includes a second positioning block 122, and a second stop side 1222 on the second positioning block 122. Now, the first circuit board 20 disposed on the first connecting module 2 is abutted and fixed by the second stop side 1222 through the first positioning block 102. Similarly, the second circuit board 30 disposed on the second connecting module 3 is abutted and fixed by the first stop side 1022 through the second positioning block 122. Therefore, the first connecting module 2 and the second connecting module 3 disposed alternately at upper and lower sides are fixed into the casing 1 simultaneously, and the casing contains two connecting modules at the same time, so that the present invention can provide a wider scope of applicability.

Figure 5:
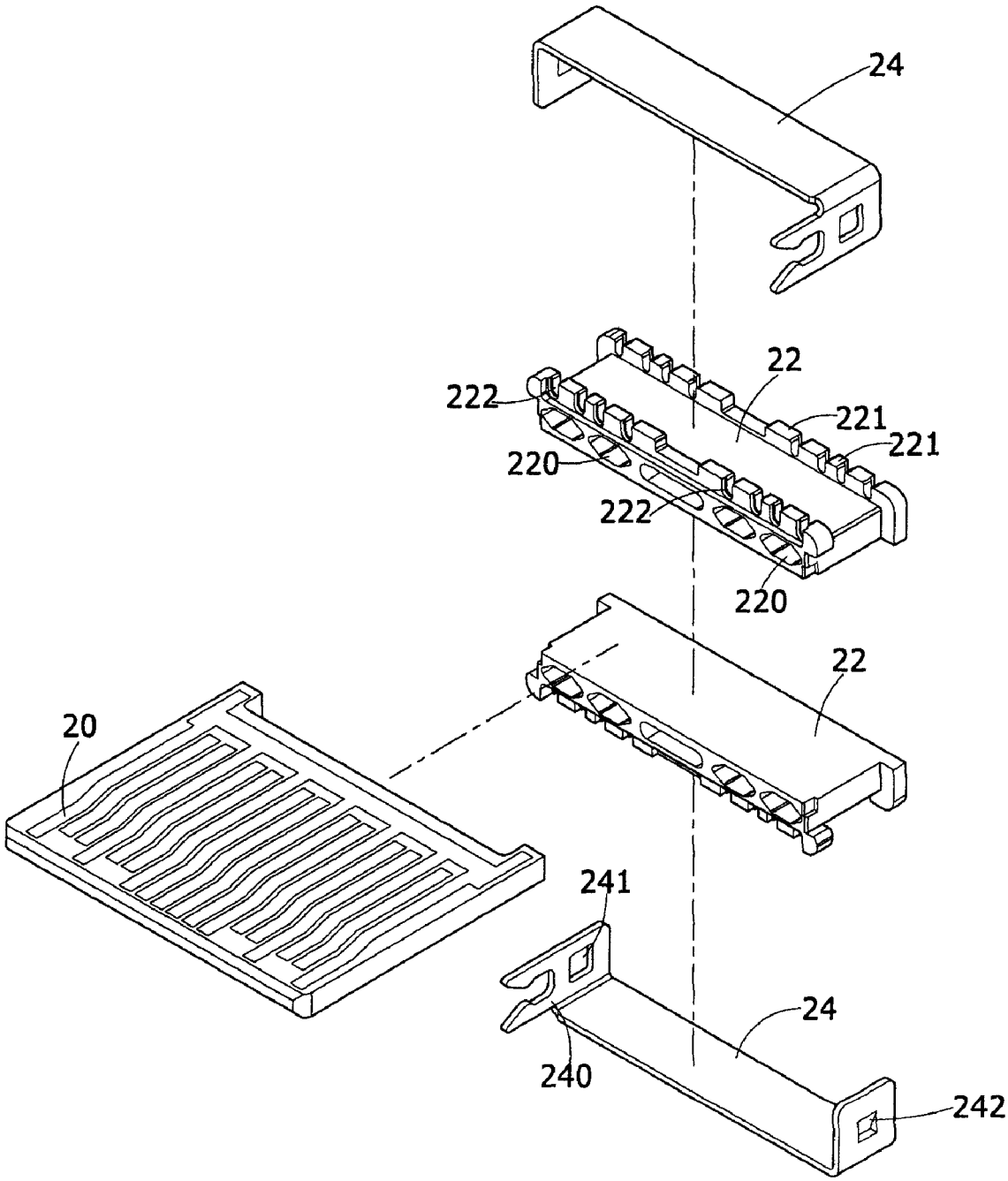
FIG. 5 is an exploded view of a connecting module in accordance with another preferred embodiment of the present invention.

With reference to FIG. 5 for an exploded view of a connecting module in accordance with a preferred embodiment of the present invention, and FIGS. 2 to 4 as well, an end of the first circuit board 20 of the first connecting module 2 is coupled to the first wire clamping module 22 and the first grounding clamp module 24. The first wire clamping module 22 is provided for collecting the signal lines, and the first grounding clamp module 24 is provided for clamping the first wire clamping module 22 integrally. Similarly, an end of the second circuit board 30 of the second connecting module 3 is coupled to the second wire clamping module 32 and the second grounding clamp module 34. The second wire clamping module 32 is provided for collecting the signal lines, and then the second grounding clamp module 34 is provided for clamping the second wire clamping module 32 integrally.

Since the first connecting module 2 and the second connecting module 3 have the same structure, except their disposing positions in the casing 1 are different, therefore only the internal structure of the first connecting module 2 will be described in details as follows.

The first wire clamping module 22 is formed symmetrically by two identical plastic clamping plates, and each plastic clamping plate includes a plurality of wire slots 220 penetrated through the plastic clamping plate and a plurality of flanges 221 corresponding to the signal lines for disposing a plurality of clamp openings 222 of the signal lines respectively.

The first grounding clamp module 24 is formed symmetrically by two identical metal clamps, and each metal clamp includes a fork frame 240 and a latch hole 241 disposed on a side of the metal clamp, and a latch plate 242 corresponding to the latch hole 241, such that the fork frames 240 are provided for clamping the first circuit board 20. During the assembling process, each signal line at an end of the cable is passed and fixed into a wire slot 220 of the two plastic clamping plates, and then the two metal clamps are latched and integrated to external sides of the two plastic clamping plates (as shown in FIG. 5), so that the invention has the advantages of a simple assembling process and a lower manufacturing cost.

In addition, a plastic injection molding process or a metal die casting process can be used for integrating the upper casing 10 and the lower casing 12 of the casing 1 in accordance with the present invention. For example, zinc is used for the die casting process to form the upper casing 10 and the lower casing 12, and then the upper and lower casings 10, 13 are integrated with each other to form the casing 1.

In summation of the description above, the signal line connector structure of a computer system of the present invention uses the wire clamping module and the grounding clamp module to provide an overall secured and convenient assembly, while the casing contains two connecting modules at the same time to provide a wider scope of applicability. The present invention improves over the prior art and complies with patent application requirements, and thus is duly filed for the patent application.

While the invention has been described by device of specific embodiments, numerous modifications and variations could be made thereto by those generally skilled in the art without departing from the scope and spirit of the invention set forth in the claims.

What is claimed is:

1. A signal line connector structure of a computer system, comprising:

a casing, comprising:

an upper casing, having a first positioning block, and the first positioning block having a first stop side; and a lower casing, coupled to the upper casing, and having a second positioning block, and the second positioning block having a second stop side;

a first connecting module, disposed in the casing, and comprising:

a first circuit board, abutted and fixed by the second stop side through the first positioning block;

a first wire clamping module, for collecting the signal line; and a first grounding clamp module, for clamping the first wire clamping module integrally and connecting the first circuit board; and a second connecting module, disposed in the casing, and comprising:

a second circuit board, abutted and fixed by the first stop side through the second positioning block;

a second wire clamping module, for collecting the signal line; and a second grounding clamp module, for clamping the second wire clamping module integrally, and connecting the second circuit board.

2. The signal line connector structure of a computer system as recited in claim 1, wherein the casing is integrally formed by a plastic injection molding.

3. The signal line connector structure of a computer system as recited in claim 1, wherein the casing is formed by a metal casting.

4. The signal line connector structure of a computer system as recited in claim 2, wherein the first wire clamping module and the second wire clamping module are formed symmetrically by two identical plastic clamping plates, and each plastic clamping plate includes a plurality of wire slots penetrated through the plastic clamping plates and a plurality of flanges corresponding to the signal line for disposing a plurality of clamp openings of the signal line.

5. The signal line connector structure of a computer system as recited in claim 4, wherein the first grounding clamp module and the second grounding clamp module are formed symmetrically by two identical metal clamps, and each metal clamp includes a fork frame and a latch hole formed on a side of the metal clamp, and a latch plate formed on another side of the metal clamp and corresponding to the latch hole, such that the fork frames can be provided for clamping the first circuit board and the second circuit board respectively.

6. The signal line connector structure of a computer system as recited in claim 3, wherein the first wire clamping module and the second wire clamping module are formed symmetrically by two identical plastic clamping plates, and each plastic clamping plate includes a plurality of wire slots penetrated through the plastic clamping plates and a plurality of flanges corresponding to the signal line for disposing a plurality of clamp openings of the signal line.

* * * * *